United States Patent [19]

Huddle

[11] 3,953,955

[45] May 4, 1976

[54] ERECTION METHOD FOR A VAULTED MEMBRANE STRUCTURE

[75] Inventor: Carl F. Huddle, Pleasant Ridge, Mich.

[73] Assignee: Tension Structures Co., Pleasant Ridge, Mich.

[22] Filed: Nov. 13, 1974

[21] Appl. No.: 523,459

Related U.S. Application Data

[60] Continuation-in-part of Ser. No. 323,539, Jan. 15, 1973, abandoned, which is a division of Ser. No. 93,293, Nov. 27, 1971, abandoned.

[52] U.S. Cl. ..... 52/745; 52/63; 52/86; 135/4 R

[51] Int. Cl.[2] ..... E04G 21/14; E04B 1/32; E04B 1/344; E04B 1/347

[58] Field of Search ..... 52/63, 86, 745; 135/1 R, 4 R, DIG. 1

[56] References Cited

UNITED STATES PATENTS

| | | | |
|---|---|---|---|
| 2,225,972 | 12/1940 | Brogren | 135/4 R |
| 2,797,696 | 7/1957 | Fritsche | 135/1 R |
| 2,806,477 | 9/1957 | Fritsche | 135/4 R |
| 3,240,217 | 3/1966 | Bird et al. | 135/3 R |
| 3,496,686 | 2/1970 | Bird | 52/2 |

*Primary Examiner*—Werner H. Schroeder
*Assistant Examiner*—Conrad L. Berman

[57] ABSTRACT

A tent-like structure, hereinafter called a vaulted membrane structure that has a series of curved arches and a panel of flexible covering material attached to and tensioned between each pair of arches. In one embodiment, the arches on each side of an intermediate portion of the pavilion are mounted to swing in opposite directions between upright and recumbent positions. The arches, except the outermost, are mounted to swing on offsets which increase in length toward an intermediate portion of the pavilion to facilitate attaching of the covering material to the arches and to tension the covering material. The covering material between each pair of arches is depressed to minimize flutter and vibration and to enhance its load-carrying capacity and is attached to the arches by inserting beads on its edges into tunnels in or attached to the arches and held therein by a locking strip.

In another embodiment, the arches are movable toward and away from each other to attach the covering material to the arches and to tension the membrane.

The structure may be made of curvilinear, circular or ellipsiodal form as well as straight.

13 Claims, 11 Drawing Figures

ERECTION METHOD FOR A VAULTED MEMBRANE STRUCTURE

BACKGROUND OF INVENTION

This application is a continuation in part of the application Ser. No. 323,539, now abandoned, which was a divisional application of the parent application Ser. No. 93,293, filed Nov. 27, 1971, now abandoned. The parent application is corrected, amended and clarified in this application.

The invention relates to a method of erection of vaulted membrane shelters consisting of a highly tensioned flexible membrane supported by a framework of curved arches, arranged in a modular pattern.

SUMMARY OF INVENTION

The objects of the invention are to provide a structure of this type in which the tendency of the covering material to wrinkle and to flutter or vibrate in gusty winds is minimized and the ability of the covering material to carry heavy loads of snow or ice without undue strain is increased, by sufficient curved depression of the tensioned covering material. Construction and methods of assembling and erection such structures which, among other things, facilitates the attainment of the first-mentioned objectives.

For a better understanding of the nature and objects of the invention, reference is made to the following specification and the accompanying drawing wherein the preferred embodiment of the invention is described and shown.

DESCRIPTION OF PREFERRED EMBODIMENT

Figure 1:
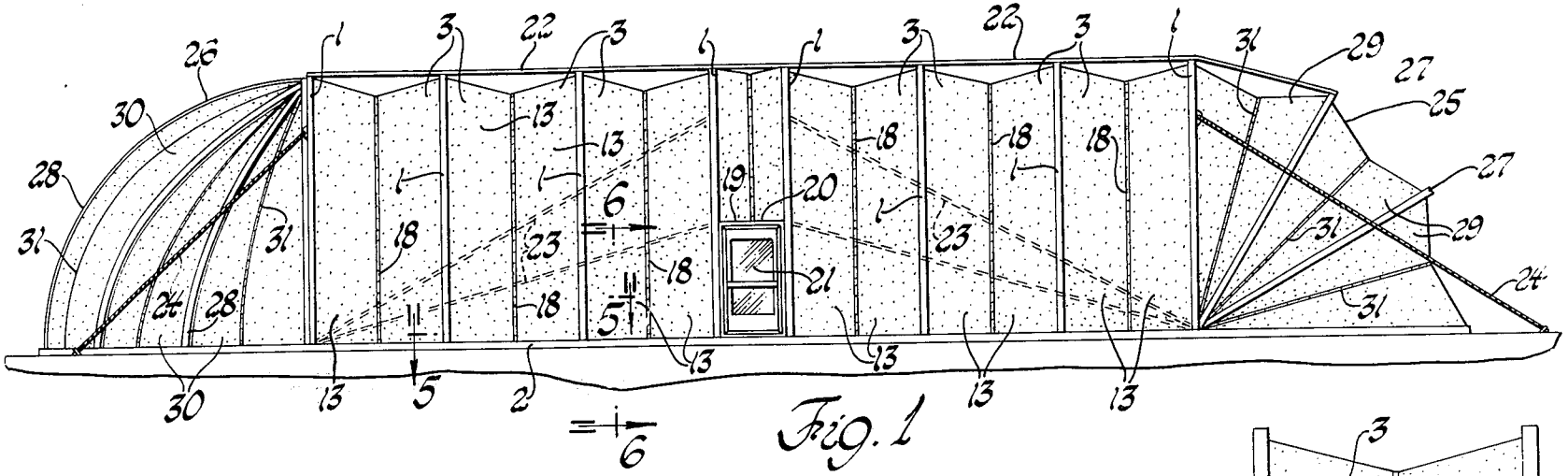
FIG. 1 is a side elevation of a vaulted structure in accordance with the invention.
Figure 3:
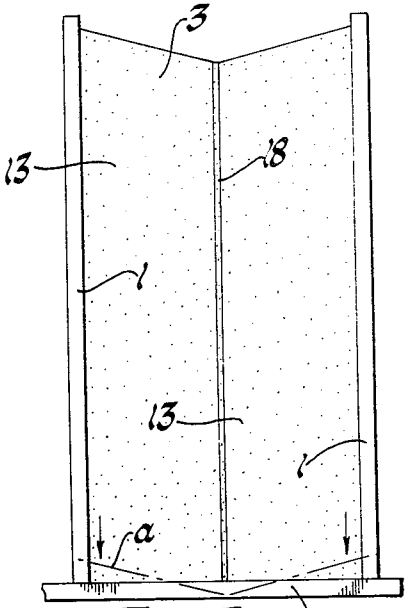
FIGS. 3 and 4 are simplified illustrations of steps in assembling the structure shown in FIGS. 1 and 2.
Figure 2:
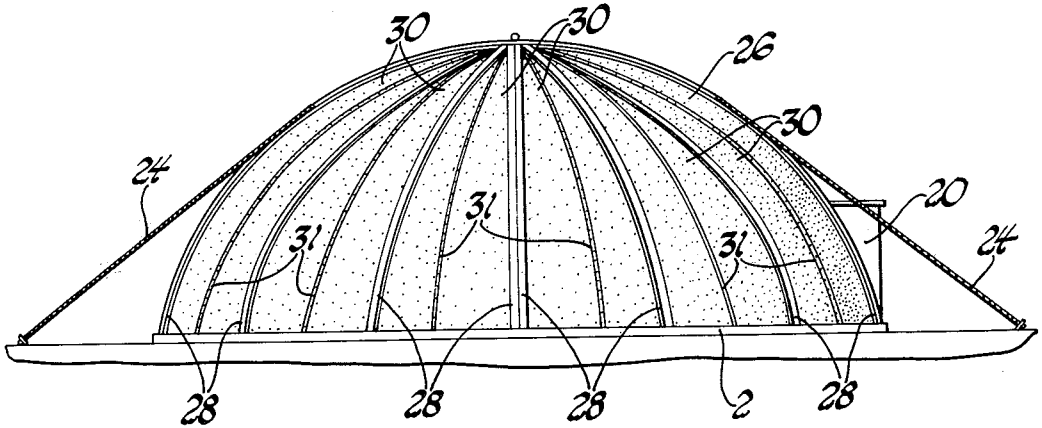
FIG. 2 is left-end elevation of the structure shown in FIG. 1.

The vaulted structure shown in FIGS. 1–7 of the drawing includes a series of curved arches 1 mounted to swing on the ground or other base 2 toward and away from the middle of the structure from recumbent to upright positions and vice versa. Between each pair of arches, except the middle pair, there extends a panel 3 of flexible membranous covering material, such as a suitable coated fabric which is stretchable within limits. One edge of each panel 3 is attached to each of the arches through the intermediary of an anchor strip 4 which is shown bonded to the inner sides of the arches but may, alternatively, be applied to the outer sides thereof.

Along each side of each of the strips 4, there extends a tunnel 5 and along the outer face of the strip between the tunnels 5 a third tunnel 6. Into the tunnels 5 from the sides of the strip, there extend slits or narrow slots 7 and into the tunnel 6 from the outer side of the strip, there extends a wider slot 8. On the edges of the panels 3 of covering material there are formed beads 9 which are disposed in the tunnels 5 and locked therein by the lips 10. The webs 11 which separate the tunnel 6 from the tunnels 5 are made flexible so that the slits or slots 7 may be opened to admit the beads into the tunnels 5. After the beads have been inserted into the tunnels 5, the lips 10 are locked against separation by introducing a filler 12 into the tunnel 6 and the beads thus retained in the tunnels.

The panels of covering material or membrane are made of shallow trough-shape, surfaces 13, instead of one broader surface, in order to minimize the tendency of the material to flutter or vibrate in gusty winds and to enhance its ability to carry heavy loads of snow or ice without undue strain. The maximum depression of the panels is preferably at least 5 to 10% of the distance between the arches.

To facilitate the realization of the structure described with the widths of covering material under tension to minimize wrinkling and fluttering, the following expedient is employed:

There is provided on the lower ends of the legs of the arches 1, except the outermost arches, lateral extensions 14 of increasingly greater length and the arches are mounted to swing on the extremities of these extensions. As a result of this, when the arches are in recumbent positions, their summits, as well as their legs, are nearer together than when they are in erected positions which facilitates introduction of the beads 9 on the edges of the panels 3 of covering material into the tunnels 5 when the arches are in recumbent positions. When the arches are swung to upright positions, they move farther apart at the base. After the arches have been swung to upright positions, the lateral extensions may be fixed to the base 2 by bolts 15.

Figure 4:
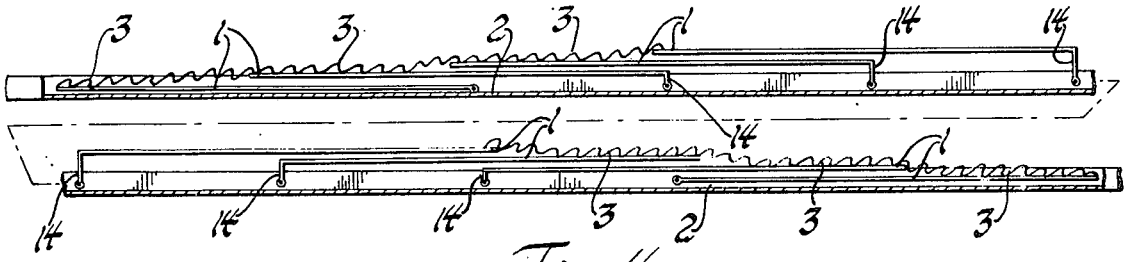
Figure 5:
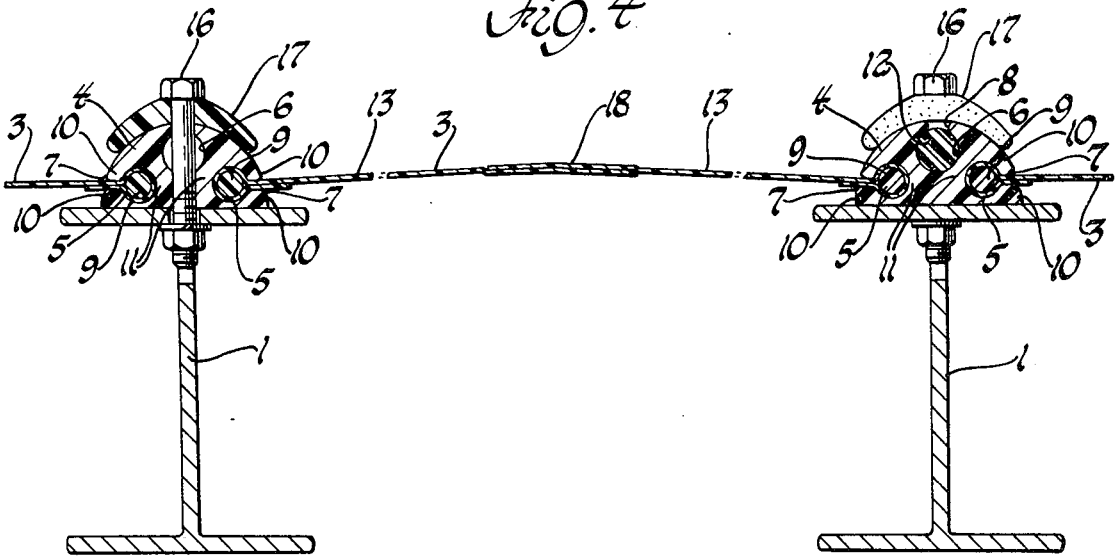
FIGS. 5 and 6 are sections on the lines 5—5 and 6—6 of FIG. 1.
Figure 6:
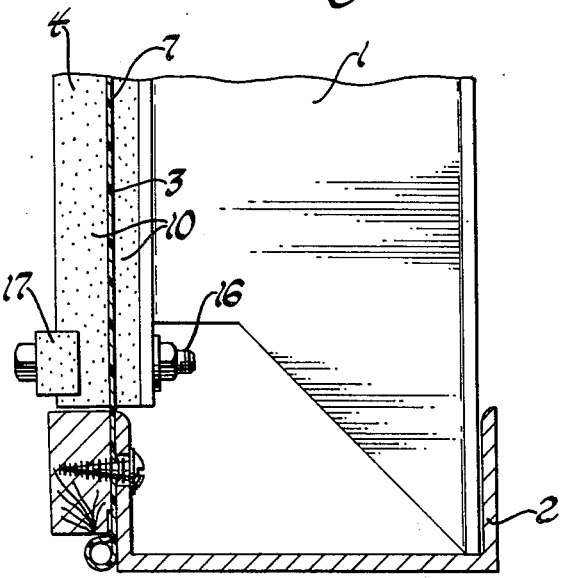
Figure 7:
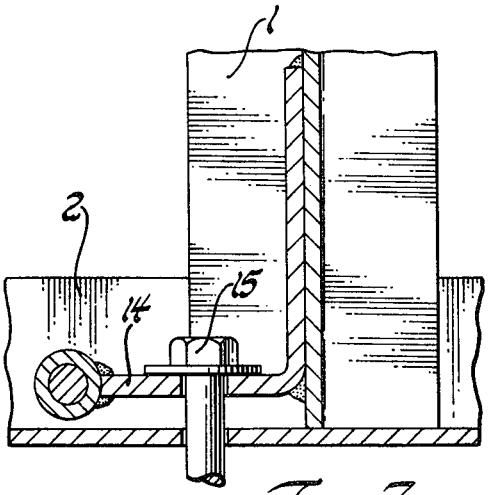
FIG. 7 is a section taken at a right angle to FIG. 6 through the lower end of a leg of one of the arches.
Figure 8:
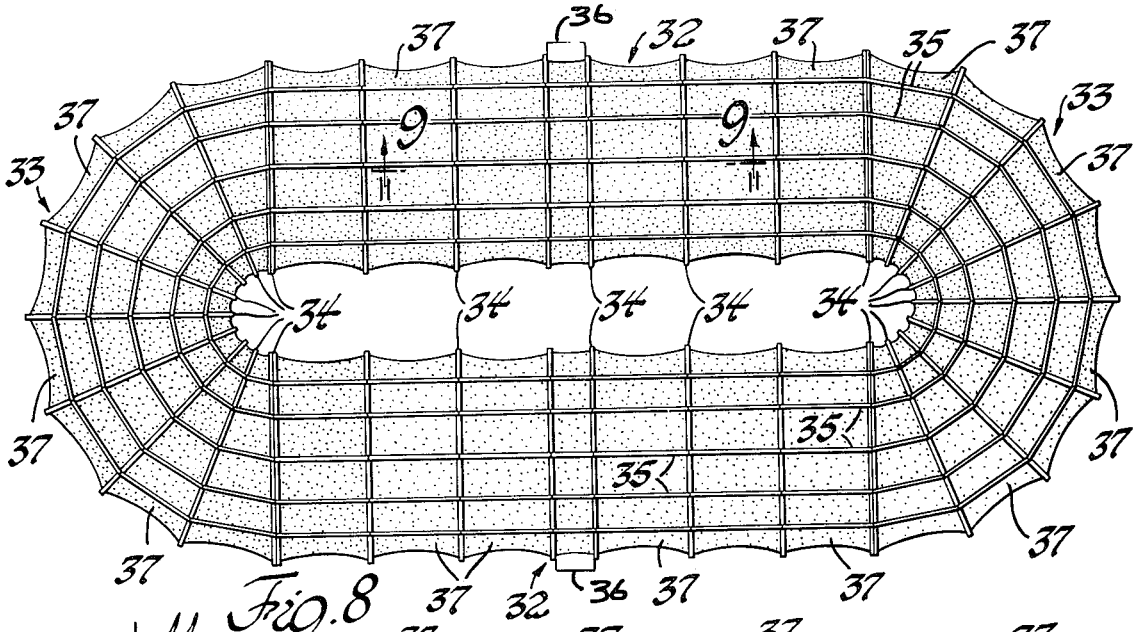
FIG. 8 is a top plan view of another structure in accordance with the invention.
Figure 9:
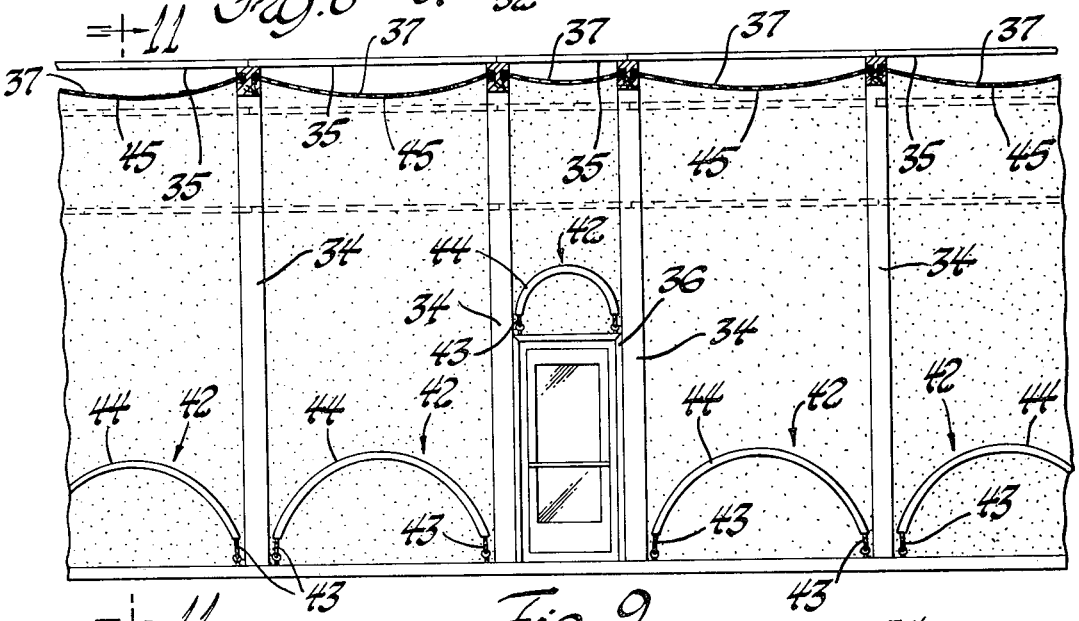
FIG. 9 is an enlarged view on the line 9—9 of FIG. 8.
Figure 11:
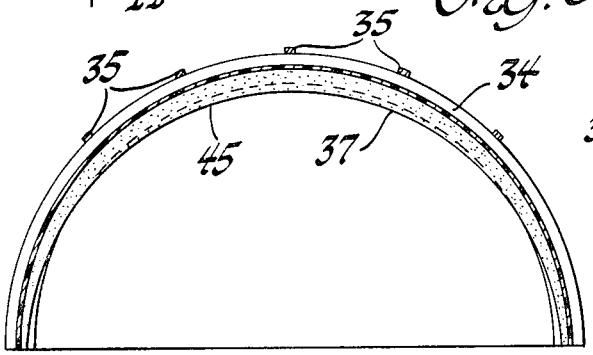
FIG. 11 is a view on the line 11—11 of FIG. 9.
Figure 10:
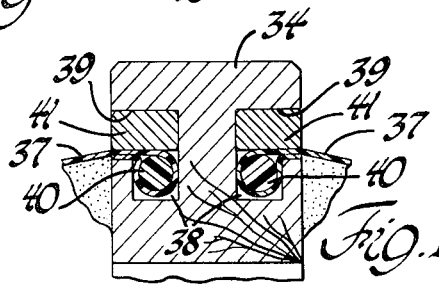
FIG. 10 is an enlarged view of the section of one of the arches shown in FIG. 9.

To impart a wrinkle free trough-shape to the widths of a stretchable covering material, the following expedient can be employed instead of starting with exact preformed widths:

To start with, a flat width of covering material of nearly rectangular, or other appropriate shape and of the length necessary to follow the contour of the arches 1 at the base of the trough and of the proper width with beads 9 in its edges is employed. This width is attached to a pair of arches 1, in the manner described, when the arches are in recumbent positions as shown in FIG. 4. Then the edges of the width are stretched to the extent necessary to make them of the same length as the periphery of the arches by drawing their ends down to the bottoms of the legs of the arches as diagrammatically indicated in FIG. 3 in which the broken line "a" indicates the disposition of the lower edge of the width before the lateral edges are stretched. This may be done either by pulling the lower ends of the edges of the width to the bottoms of the legs or by anchoring the lower ends of the edges and raising the bottoms of the legs. When the lateral edges of the width have been drawn down to the bottoms of the legs of the arches, they are clamped there by bolts 16 and jaws 17. The stretching operation is illustrated as it is in FIG. 3 primarily to facilitate and simplify illustration, but it may also actually be done while the arches are in upright positions as well as when they are in recumbent positions.

To prevent the valleys of the troughs in the widths of covering material stretching with the edges, they may be reinforced with webbing or other fabric, cord or rope or additional thicknesses of membranous plastic 18.

The space between the middle pair of arches 1 may be closed by a panel 19 of covering material attached to the arches in any suitable manner, or with an entry 20 and a door 21.

The arches 1 may be kept properly spaced at their summits by purlins or a cable 22. In the latter case, and preferably also in the former, the arches are also aligned in an upright position by guys 23 connected to the middle pair of arches and to the base 2 at the lower ends of the outermost arches. Guys 24 are connected to the outermost arches and to the base beyond the limits of the structure to pull the arches 1 apart above the base to tension the covering material 13 when a cable 22 is used to space the arches.

Suitable closures may be provided for one or both ends of the structure such as the accordion-like structures 25 and 26 shown in the drawing, which may be collapsed to open the ends. The closures 25 and 26 are generally similar in construction to the body of the structure in that they are made up of arches 27 in the case of the closure 25 and semi-arches 28 in the case of the closure 26 and widths 29 and 30 of flexible covering material which extend between and are attached to the arches.

However, the arches 27 of the closure 25 are mounted on the base 2 near the lower ends of one of the outermost arches 1 to swing about a horizontal axis upwardly to collapse the closure and open the end of the structure and downwardly to close it.

The summits of the semi-arches 28 of the closure 26, on the other hand, converge at the summit of the other outermost arch 1. The closure 26 is made in two halves which meet at a projection of the center line of the structure to close the end of the structure. The semi-arches are, however, mounted to swing about a vertical axis at the point of convergence of their summits to collapse each half against a leg of the end arch 1 and open the end of the structure.

To facilitate folding of the panels 29 and 30 of covering material when the end closure 25 and 26 are collapsed, spring-tensioned cables 31 with low friction coatings may be disposed in the valleys or in tunnels in the valleys of the panels of covering material and anchored to the base 2.

Vaulted structures in accordance with my invention may be curvilinear or circular or ellipsoidal in shape instead of straight and include modules of different widths, shapes and materials.

Different means of attachment of the covering material to the arches and different methods of depressing and tensioning the flexible covering material between the arches may be also employed. A structure in which some of these and additional features are employed is illustrated in FIGS. 8 to 11.

The structure shown in FIGS. 8–11 is shaped like an ellipsoid or an elongated doughnut. It consists of two similar straight sections 32 disposed side by side with their ends interconnected by curved sections 33.

The sections 32 are similar in a general way to the body of the structure shown in FIGS. 1–7 and the sections 33 are also generally similar except in that the arches 34 converge toward their inner sides and the modules are, therefore, frusto-triangular instead of rectangular in plan. The arches 34 are kept properly spaced by purlins 35. An entry or entries 36 with door or doors in them may be provided in one or more of the modules.

The arches may or may not be mounted to swing on the ground or other base 2 but, in either event, they are mounted so that they may be moved toward and away from each other to facilitate the attachment of covering material 37 to the arches and to tension it.

The arches 34 may be made of curved laminated wood instead of metal or other material. For attachment of the flexible or other material. For attachment of the flexible membrane panels 37 to the arches, there is provided in each side of the arches a tunnel 38 into which extends a lock slot 39 through which the beads 40 on the edges of the widths 37 may be introduced into the tunnels. To hold the beads in the tunnels there are provided lock strips 41.

After the panels of covering material are attached to the arches, the arches are moved apart sufficiently tension the panels. They are then attached to the base 2. Purlins 35 may be used to hold the arches apart and maintain the tension in the membrane instead of the cables 24.

In the panels 37 of covering material employed in the structure shown in FIGS. 8–11, the reinforcement 18 can be omitted. To tension and depress the panels of covering material between the arches near the base there can be provided near the lower edges of the panels one or more tension rings 42 of the type disclosed in my application for patent entitled Prestressed Arch Supported Membrane Shelter Ser. No. 336,228 filed Feb. 27, 1973. Where tension rings are used, there should be provided at least one tension ring for each surface 37. Each of these tension rings consists of a cable 43 which extends through an arched tunnel 44 in or on the panel of covering material with its ends attached to the base 2. The cable may itself be a spring member or be attached to the base by a spring as shown in my application above identified.

The cables 44 are tensioned sufficiently to draw the edges of the panels of covering material towards the lower ends of the arches, tension the membrane widths and depress the intermediate portion near the base.

When the arches are moved apart the flexible membrane is tensioned longitudinally and transversely as the depressed membrane tried to "straighten out" or tries to form a shallower depression between the arches. When sufficient separating force is applied to the arches the flexible membrane becomes stiff, like the membrane on a drum, which adds great stability to the structure.

The roof membrane may be attached directly to the base without an inward depression along the base if side snow loads by drifting or piling are below the membrane elastic limit. Above this area, the membrane curves transversely with the arches and inwardly between the arches longitudinally to form a tensioned roof of double curvature.

I claim:

1. A method of constructing a vaulted membrane shelter, said vaulted membrane shelter having a structural frame comprised of a multiplicity of substantially vertical arches with curved bights, spaced apart in parallel relationship with their respective ends and apexes aligned, operatively mounted on a base to permit horizontal separating movement; a flexible roof membrane extending between and operatively attached to said arches and said base that is tensioned to a stiffened and substantially wrinkle-free state with an inward concave curvature between the bights of said arches which has a circumferential length in a vertical plane midway between said arches, that is at least 4% less than its circumferential length where it is operatively attached to adjacent vertical arches; means to fix said vertical arches in their erected position to maintain tension in said roof membrane, said method comprising the following steps:

a. assembling and disposing said arches on the base in recumbent positions with their corresponding ends aligned in their erected relationship, their crowns similarly oriented but spaced apart to facilitate attachment of said membrane,
b. prefabricating said membrane such that its circumference, in a vertical plane midway between said arches, is less than its circumference where it is operatively attached to said adjacent vertical arches,
c. operatively attaching said roof membrane to at least a portion of the crown of said arches,
d. raising the end arch, that swings away from the remaining arches, to an upright position which, in turn, partially raises at least one adjacent arch,
e. raising the opposite end arch of the shelter, or a section thereof, to an upright position,
f. moving said arches apart to their approximate erected position,
g. tensioning said roof membrane,
h. fixing said arches in space,
i. securing the lower portion of said membrane between the arches.

2. The method described in claim 1 wherein the steps (d) and (e) are being performed substantially simultaneously.

3. The method described in claim 2 wherein the steps (d) and (e) are performed in successive smaller intermediate steps.

4. The method described in claim 1 step (g) wherein the tensioning of said roof membrane includes the elongation of at least one extensible purlin.

5. The method described in claim 1 step (g) wherein the tensioning of said roof membrane includes increasing the tension stress in at least one tension member that extends between an end vertical arch and said base.

6. The method described in claim 5 wherein the tensioning of said roof membrane includes increasing the tension stress in at least one tension member that extends between an end vertical arch and a tensioning means operatively attached to said base.

7. The method described in claim 1 wherein the tensioning of said roof membrane in step (g) includes the movement of end closure arches, operatively attached to said roof membrane, away from the center of said shelter.

8. The method of erection of the shelter described in claim 1 wherein the shelter comprises an end closure that includes an arch inclined outward from the body of the shelter, with its ends attached to said base adjacent to the respective ends of an end arch; a closure membrane extending between, and operatively attached to, said end arch and said inclined arch, and also between said inclined arch and said base, said method further comprising tensioning said closure membrane when performing step (g).

9. The method of erection of the shelter described in claim 1 wherein said shelter includes an end closure that comprises at least one semi-arch having one end attached to the crown of one vertical end arch, and the other end operatively attached to said base, said method further comprising moving outwardly said semi-arch away from the center of the shelter in step (g) to tension said roof membrane.

10. The method of erection of the shelter described in claim 1 except that said shelter is comprised of a multiplicity of substantially vertical arches with their apexes aligned but in non-parallel relationship.

11. The method of erection of the shelter described in claim 1 except that said shelter is comprised of a multiplicity of substantially vertical arches with their apexes non-aligned and spaced in a non-parallel relationship.

12. The method of erection of the shelter described in claim 1 wherein said structural frame of said shelter includes at least one extensible purlin attached to, and extending between said vertical arches.

13. The method of erection of the shelter described in claim 12 except that said roof membrane is operatively attached to said vertical arches after step (e) and before step (f).

* * * * *